US009261315B2

(12) United States Patent
Travis

(10) Patent No.: US 9,261,315 B2
(45) Date of Patent: Feb. 16, 2016

(54) METHOD AND SYSTEM FOR PREVENTING FIRING OF A WEAPON IN A LOCALIZED AREA

(71) Applicant: Terry Ladell Travis, West Frankfort, IL (US)

(72) Inventor: Terry Ladell Travis, West Frankfort, IL (US)

( * ) Notice: Subject to any disclaimer, the term of this patent is extended or adjusted under 35 U.S.C. 154(b) by 0 days.

(21) Appl. No.: 14/247,359

(22) Filed: Apr. 8, 2014

(65) Prior Publication Data

US 2014/0305017 A1 Oct. 16, 2014

Related U.S. Application Data

(60) Provisional application No. 61/811,222, filed on Apr. 12, 2013.

(51) Int. Cl.
*F41A 17/06* (2006.01)
*F41A 17/46* (2006.01)

(52) U.S. Cl.
CPC ..... *F41A 17/063* (2013.01); *F41A 17/06* (2013.01); *F41A 17/46* (2013.01)

(58) Field of Classification Search
CPC ..... F41A 17/46; F41A 17/06; F41A 17/00; F41A 17/063
USPC ..... 42/70.04, 70.06
See application file for complete search history.

(56) References Cited

U.S. PATENT DOCUMENTS

| | | | | |
|---|---|---|---|---|
| 5,168,114 | A | 12/1992 | Enget | |
| 5,564,211 | A * | 10/1996 | Mossberg et al. | 42/70.11 |
| 5,755,056 | A * | 5/1998 | Danner et al. | 42/84 |
| 6,412,207 | B1 | 7/2002 | Crye et al. | |
| 8,127,482 | B2 | 3/2012 | O'Shaughnessy et al. | |
| 2006/0213972 | A1 * | 9/2006 | Kelley et al. | 235/380 |
| 2007/0290820 | A1 * | 12/2007 | Flesch | 340/426.32 |

* cited by examiner

*Primary Examiner* — Stephen M Johnson
(74) *Attorney, Agent, or Firm* — Clark & Brody

(57) ABSTRACT

A method and system for preventing the firing of a gun comprises a component on the gun for preventing the gun from being fired, for example, preventing the trigger from being pulled when the gun is in an area that has a wireless power sending source configured to send power to the component for firing prevention. There is no need for a battery on the gun or the transfer of any information between the component and the wireless power sending source, the power being emitted from the source and received by the component controls the firing capability.

10 Claims, 6 Drawing Sheets

METHOD AND SYSTEM FOR PREVENTING FIRING OF A WEAPON IN A LOCALIZED AREA

This application claims priority under 35 USC 119(e) based on application No. 61/811,222, filed on Apr. 12, 2013.

FIELD OF THE INVENTION

The invention relates to a method and system for preventing firing of a weapon in a localized area, and particularly to a method and system that uses a power receiver on a gun and a gun locking mechanism that interact together to prevent the gun from firing.

BACKGROUND ART

The problem with shootings occurring in locations where children and crowds of people are present are well known. There have been a number of mass shootings in schools, work areas, and the like. FIG. 1 shows an example of a prior art gun. The gun is designated by reference numeral 10 and is representative of an AR-15 weapon. Since the features of this weapon are well known, there is no need to provide a detailed description of its features.

Based on the number of shootings that have taken place in crowded locations, there is a need to provide improved safeguards in these locations so that such shootings do not occur.

SUMMARY OF THE INVENTION

The invention is a gun shield system designed to provide safe areas where firearms equipped with the gun shield system would not function. Most currently-existing firearms can be manufactured new or be retrofitted with the gun shield system. These firearms would function normally in all other circumstances that were outside the area that is protected by the gun shield system. Areas that can be protected will include buildings, outdoor venues with secured entrances, transportation vehicles including buses, trains, airplanes, and most any other enclosed area. A second function for the gun shield system could be the use of the system as a mobile safe area that moves with a vehicle for a small gun safe area around the transport method for the system, such as a motorcade or police car.

The inventive method and system provide a way to keep a particular location safe in terms of controlling the ability of a gun to be discharged. This is accomplished by the system having a number of different features.

One feature relates to the modification of an existing gun or a newly manufactured gun. In either case, the gun has a trigger mechanism that includes a wireless power receiver, and an activatable trigger blocking device.

Another feature of the invention relates to a control feature to ensure that the system is operating properly, needs maintenance and repair and the like. This control can include a redundant processing unit to monitor system diagnostics and report back down or inoperable components or other needed repairs. The control feature may also control backup generator or other back up power supplies. Another feature of the invention relates to one or more wireless power sending units These units supply wireless power for the wireless power receiver and activatable trigger blocking device on the gun.

In more detail and in one embodiment, the inventive gun shield system is a system that will block the functioning of a gun that has passed within the specified distance from the wireless power units of the system. The system for protecting an area from discharge of a gun comprises a trigger blocking device on the gun that prevents the trigger from being pulled when the trigger blocking device is activated, and means for activating the trigger blocking device to prevent the trigger from being pulled. The activating means includes a plurality of wireless power sending device located in the area intended to be protected from any gun having the features of the invention from discharging.

The system can also include a control to monitor the activating of the trigger blocking to record trigger blocking events for reporting and the like.

The system can also include a back up power supply for the means for activating and/or a back up activating means and optionally a control to monitor the back up power supply and back up activating means.

The invention also entails a method of protecting an area from discharge of a gun comprising the steps of providing a trigger blocking device on a gun that prevents the trigger from being pulled when the trigger blocking device is activated. Also provided are a plurality of wireless power sending units in an area to be protected. The power sent by the wireless power sending units is capable of activating the trigger blocking device and preventing the trigger from being pulled. The use of the wireless power sending units means that the fun will be prevented from firing without the need for a battery on the gun itself.

The activating of the trigger blocking device would occur when the gun is in the range of the wireless power sending units. When the gun is outside the range of the sending units, the gun trigger can be pulled. Also, when the gun is outside the range of the sending unit and the activation of the firing cycle blocking occurs, no information is exchanged between the gun and the wireless power supply and/or there are no codes that are read, received, or transferred between the power supply and trigger blocking device. If the gun is within the range of the wireless power sending units and the trigger blocking mechanism is activated, information can be exchanged between the gun and the control so that the occurrence of the locking of the trigger mechanism is known so that the appropriate action can be taken.

The activation of the trigger blocking device prevents the trigger of the gun from being pulled until the trigger blocking device is either replaced, reset or changed to allow it to again be activated.

If the gun trigger is locked by the system, this locking can be reported to authorities.

The wireless power sending units can include a back up power supply so that if the primary power source for powering the wireless power sending units in not operable, the system can rely on the back up power supply to maintain functionality.

DETAILED DESCRIPTION OF THE INVENTION

The inventive system and method offer an improved way to secure a desired location by preventing the discharge of a gun having the feature of the invention. That is, when a gun is either manufactured with the devices of the invention or retrofitted with the devices of the invention, the gun cannot be discharged in a location that is designed to interface with the gun devices to prevent gun discharge. This system is independent of the desire of the person with the gun to fire the gun so that no matter the intent of the gun holder, the gun cannot be discharged once the gun is placed in the location to be detected. The method and system are such that the prevention of the gun discharge is not undoable without extensive dismantling and replacement of the trigger locking device of the gun. The disabling of the gun is also monitored by the control of the system. Therefore, the authorities can be notified that a gun has been disabled in the location to be protected and the gun holder would not have time to repair the gun prior to the authorities arriving at the location and at least securing the location.

Figure 1:
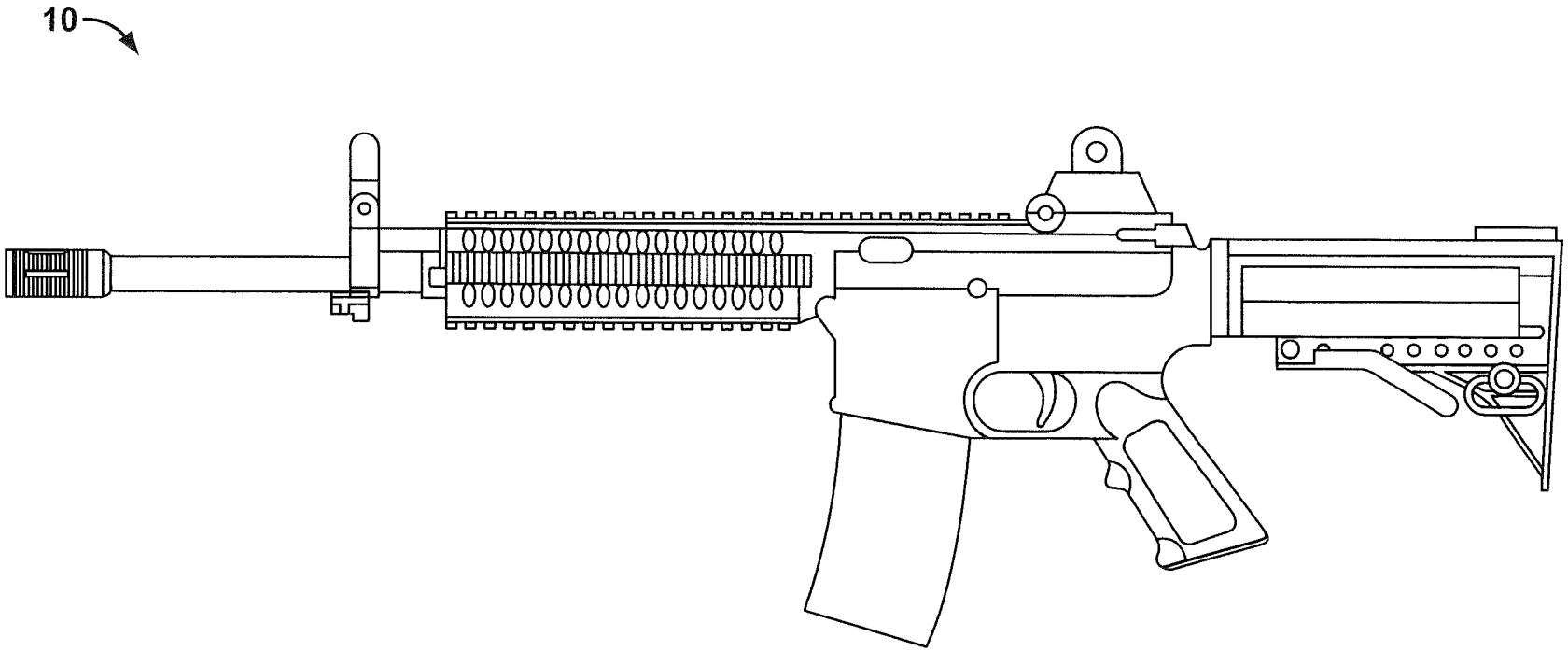
FIG. 1 (Prior Art)
FIG. 1 shows an AR-15 gun.

While any gun could be used in conjunction with the inventive system and method, an AR-15 is used as an example and one is shown in FIG. 1 and designated by the reference numeral 10. The features of the gun relevant to the invention are described in later drawings so no further details are provided with respect to FIG. 1. Moreover, since the AR-15 is well known, the features of this type of gun are in the prior art and a detailed description is not necessary for understanding of the invention.

Figure 2:
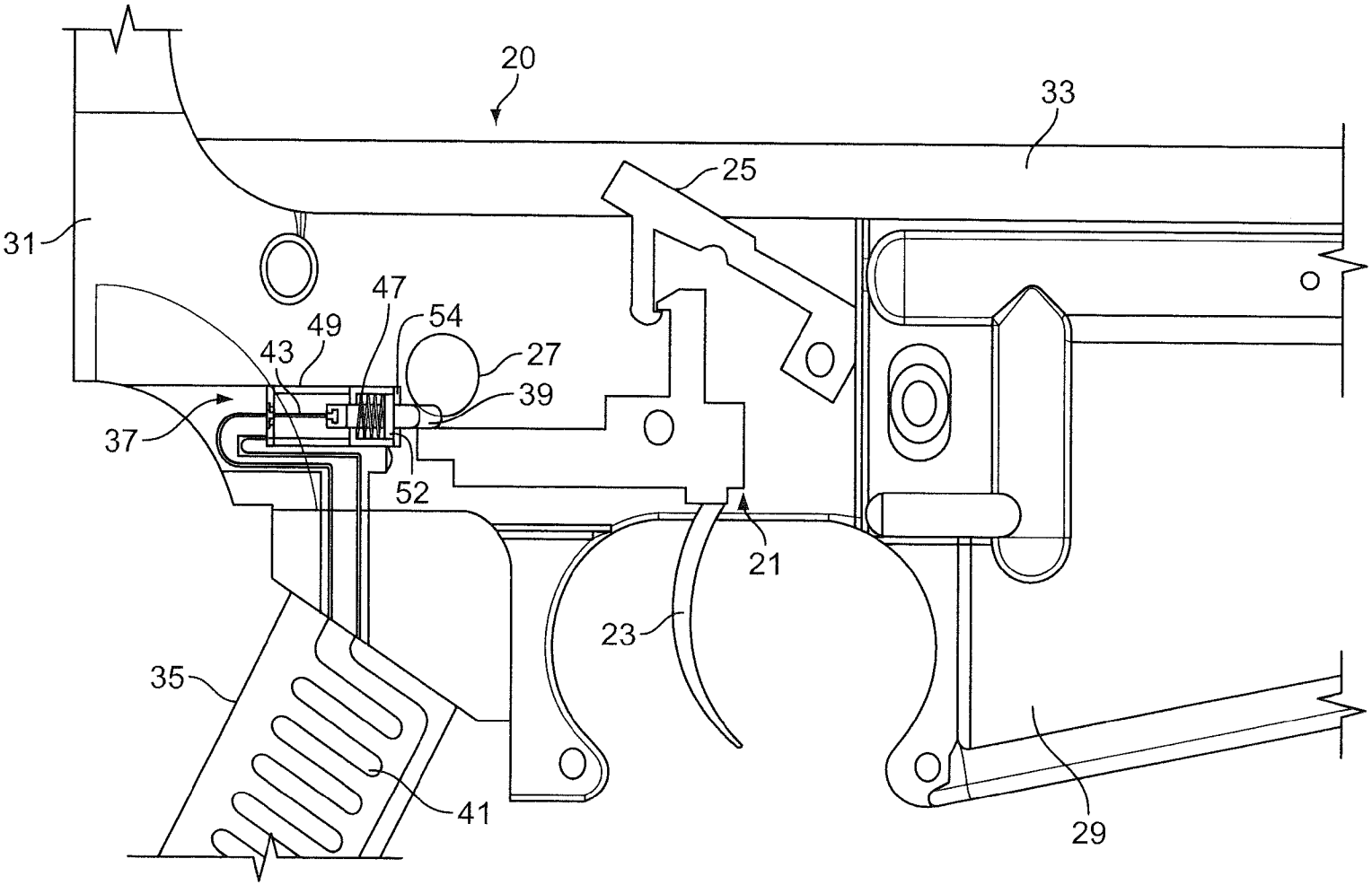
FIG. 2 shows schematic view of a portion of the gun of FIG. 1 with one embodiment of the invention.
Figure 3:
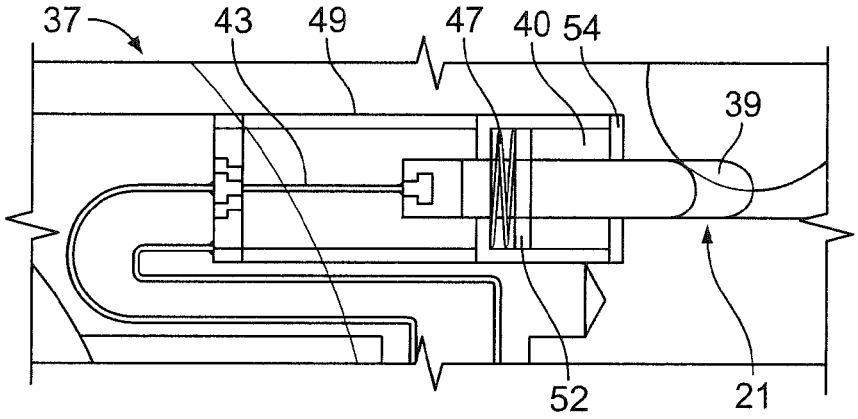
FIG. 3 shows an enlarged view of a portion of the embodiment of FIG. 2.

Referring to FIGS. 2-3, a portion 20 of the relevant components of an AR-15 are depicted with the features of the invention.

FIG. 2 shows a trigger mechanism 21 with trigger 23 and hammer 25. As is known in the art, pulling of the trigger 23 releases the trigger mechanism from the hammer 25 to allow the gun to fire.

The safety of the gun is designated by reference numeral 27, the rifle magazine is designated by 29, the lower rifle assembly is designated by 31. Reference numeral 33 represents the area containing the chamber, barrel and cartridge cycling system of the rifle. The pistol grip for the gun is designated by reference numeral 35. Since these components are well known, a more detailed description of the workings of the AR-15 are not required for understanding of the invention.

The invention adds two components to the gun 100 of FIG. 1. The first is an activable trigger locking mechanism 37. The second is a power receiver 41. The trigger locking mechanism 37 shown in FIG. 1 is one embodiment of this mechanism. This is a spring powered fusible link version. The mechanism 37 includes a pin 39. The pin, when in an extended position will block the trigger mechanism 21 from being pulled just as the normal safety located just above it. With the pin 39 retracted, the gun can discharge in normal use. The control of the movement of the pin is described below.

In combination with the locking trigger mechanism is a receiver unit 41. This unit includes a receiver component and circuitry designed to receive power from a wireless power source, which is shown in FIG. 4. The wireless power source can be any known type that will provide wireless power to the receiver component and circuitry. One example of such a wireless power source is one made by Witricity Corp, whose website is witricity.com. This website lists the patents related to this technology, e.g., U.S. Pat. No. 8,400,024 to Joannopoulos et al., all of which being incorporated by reference in their entirety herein.

The receiver component circuitry that is part of the receiver unit 41 would use this wirelessly supplied power to supply its power needs. There would be no need for a battery onboard the gun. Another aspect of the invention is the conversion of this wireless power to another form of energy that would be used to disable the firing cycle of the gun without the need for an onboard battery. The power received from the wireless power source via the receiver 41 would be used to disable the firearm by blocking the trigger, hammer or firing pin movement. The method for blocking the firing device would vary for different firearm types and would have to be developed for each firearm type. The embodiment shown in FIGS. 2-3 is specific for an AR-15 but it not intended to be limiting in terms of the actual means or device used to block the firing of the gun. Four exemplary methods are described as a way to disable the firing cycle of the gun.

The first system is a spring loaded locking pin held in place by a fusible link. The fusible link type locking system will keep the firearm disabled after being removed from the area affected by the wireless power source. Referring to FIGS. 2 and 3 in particular, the trigger locking mechanism 37 includes a fusible link 43, a pin 39, and spring 47, all contained in a housing 49. The pin 39 includes a flange 52 and the spring 47 sits between the flange 52 and housing wall 54. The spring 47 biases the pin 39 in the extension direction and the fusible link holds the pin 39 in a retracted position. The pin 39 is constantly under spring pressure to move into the blocking position and prevent the firing cycle. The pin 39 is kept from moving into this blocking position by the strength of the fusible link 43 holding it back. In FIG. 2, the pin 39 and flange 52 are shown in the extended position. FIG. 3 shows the locking mechanism 37 in the gun operational position and before the link 43 is severed. When the pin 39 is held back, a space 40 between the flange 52 and an inner surface of the wall 54 would exist and when the fusible link is cut, the spring 47 expands, the flange moves to the inner wall 54, and the pin 39 extends further to block the trigger mechanism 21.

If the firearm enters an area protected by a wireless power supply the circuitry in the receiver unit 41 will transfer the wireless energy to the fusible link so as to burn it and sever the link. With the link severed and no longer holding the pin 39, the spring 47 will extend the blocking pin and interrupt the firing cycle of the firearm where the pin blocks the action of the trigger.

To bring the firearm back to a functioning condition, it will need to disassembled and have the fusible link system replaced with a new unit.

Figure 4A:
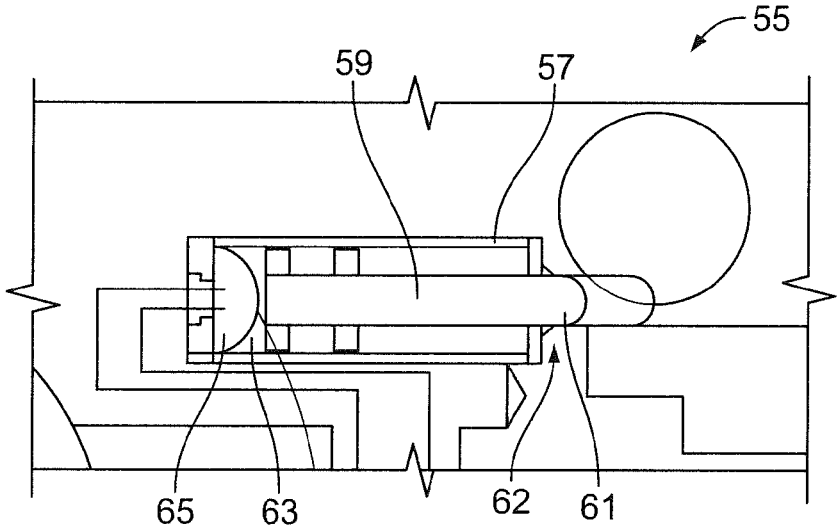
FIG. 4A shows a schematic view of a second embodiment of the invention.
Figure 4B:
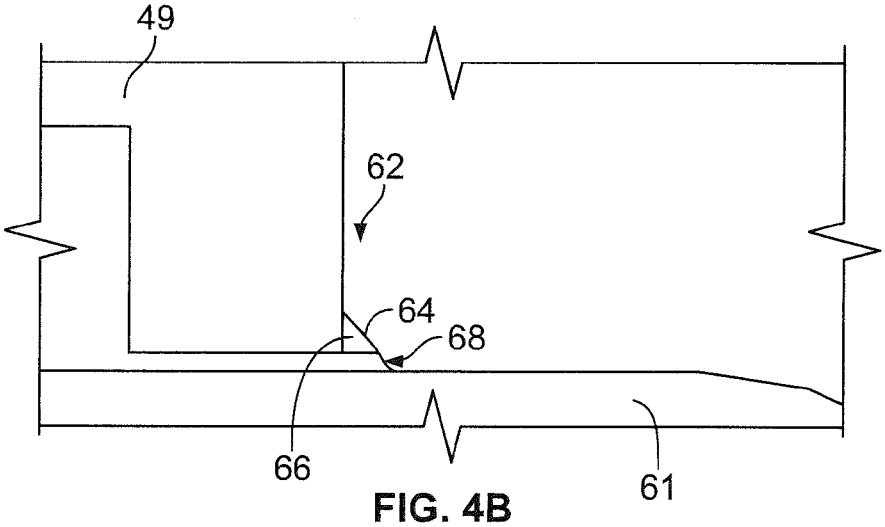
FIG. 4B shows an enlarged view of the spring locking clip of FIG. 4*a*.

A second way to disable the firing of the gun uses a cartridge type pin locking system that is powder charge deployed. This is depicted in FIG. 4A-4B, which depicts a portion of the modified gun to show greater detail about the second trigger locking mechanism. This mechanism is designated by reference numeral 55 and includes a cylinder 57 much like a pneumatic or hydraulic cylinder. This cylinder 57 will have a piston 59 with shaft 61 extending from one end. The blank end 63 of the cylinder will be filled with a small powder charge 65 and this charge will detonated. The gas produced from the detonation would drive the piston 59 forward extending the shaft 61 to block the functioning of the firing cycle of the gun. The powder charge 65 will be detonated by the application of a small amount of current from the receiver circuit 41 as powered by the wireless power source. The piston 59 and shaft 61 combination will be held in position once it is deployed by a one way spring clip locking mechanism 62. With reference to FIG. 4*b*, the mechanism includes a spring clip 64 that is mounted to the housing 49 using a block 66, although any mounting can be employed providing that the spring clip 64 is angled in the manner shown in FIG. 4B. In operation, the spring clip allows the shaft 61 to extend to the trigger blocking position. The tip 68 of the spring clip 64 digs into a surface of the shaft 61 and prevents the shaft from retracting away from the trigger blocking position. This will be a one way mechanism that will not move back in once deployed. The cartridge pin with powder charge type locking system will keep the gun disabled after being removed from the area affected by the wireless power source. To bring the gun back to functioning condition, it will need to be disassembled and have the system replaced with a new unit.

Figure 5:
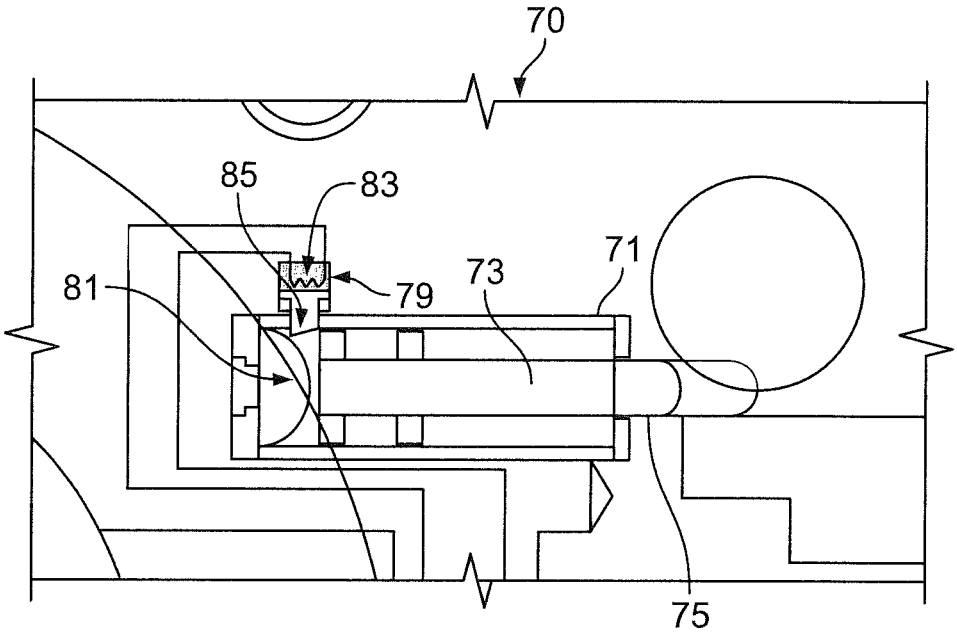
FIG. 5 shows a schematic view of a third embodiment of the invention.

FIG. 5 shows another type of locking system of the invention. This system is similar to the one shown in FIGS. 4A-4B but uses a high pressure gas in combination with the powder charge to prevent the gun from firing. This system is designated by the reference numeral 70 and includes a cylinder 71 much like a pneumatic or hydraulic cylinder. This cylinder 71 will have a piston 73 with shaft 75 extending from one end. The blank end 77 of the cylinder includes a small powder charge 79 and a very small high pressure inert gas charged section 81. When the electronic igniter 83 detonates the small powder charge 79, it ruptures the high pressure gas section 81, thereby releasing inert gas and driving the piston 73 forward extending the shaft 75 to block the functioning of the firing cycle of the gun. The powder charge 79 is detonated by the application of a small amount of current from the receiver circuit 41. The powder charge moves the lance 85 to rupture the gas foil cartridge 81 and propel the shaft 75 to its locking position. The piston and shaft combination will be held in position once it is deployed by the same spring clip mechanism 62 shown in FIGS. 4*a* and 4*b* so that it is not illustrated with this embodiment. However, it provides the same tensioning mechanism that functions as a one way mechanism that will not move back in once deployed. The cartridge pin with high pressure gas/powder deployed type locking system will keep the gun disabled after being removed from the area affected by the wireless power source. To bring the gun back to functioning condition, it will need to be disassembled and have the cartridge pin deployment system replaced with a new unit.

Figure 6:
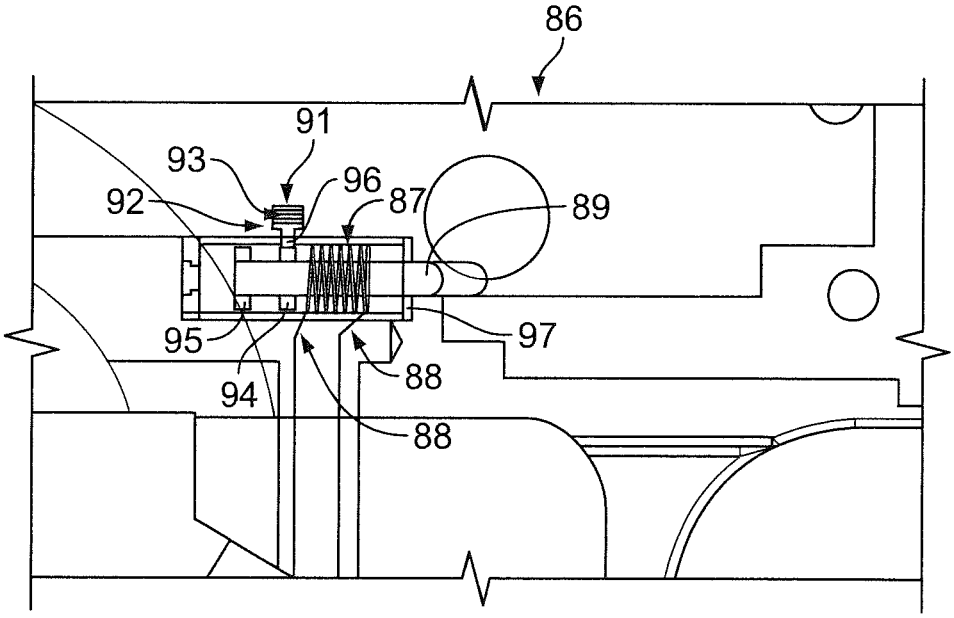
FIG. 6 shows a schematic view of a fourth embodiment of the invention.

FIG. 6 shows yet another embodiment of the trigger locking mechanism, which is designated by the reference numeral 86. That is, an electromechanical locking system that can be deployed as the result of electromagnetic force. The electromagnetic system will consist of a coil 87 of wire producing a magnetic field when receiving power from the wireless power source via the receiver unit 41 and wires 88. The magnetic field will moves a core shaft 89 just as in a standard electrical solenoid system. This core shaft movement will block the firing cycle of the gun either directly as shown in FIG. 6 or through a series of levers (not shown). This electromagnetic system can also be used in conjunction with the high pressure inert gas system to be the activator either directly or indirectly to pierce the high pressure inert gas section in a cartridge system to deploy a firing system locking pin. The electromechanical locking system can operate in two modes. Mode one will keep the firearm disabled after it is removed from the wireless power source area. In mode one, the gun would have to be disassembled to reset the electromechanical mechanism to allow the firearm to function again and this mode is discussed below. In mode two, the gun could be reset to operational upon leaving the wireless power source affected area. In mode two, the gun would require no maintenance upon leaving the wireless power source affected area. It would function normally as soon as it exited the area. In mode two, the locking mechanism described below would not be present and the control of the movement of the shaft for trigger locking purposes is controlled by the wireless power receiver receiving the power to activate the solenoid and move the shaft to the trigger locking position.

The one way movement of the shaft 89 is controlled by a spring loaded locking pin assembly 91. The assembly 91 includes a pin 92 and compression spring 93 and the shaft 89 includes two flanges 94 and 95 that interface with the pin 92. An end of the pin extends through an opening 96 in the housing 97. The pin 92 is held in a retracted position by the flange 94. When the shaft 89 moves into the trigger locking position, the flange 94 moves as well and the pin 92 can extend into the housing by reason of the spring 93 expanding. The presence of the pin end in the housing blocks the movement of the flange 94 and keeps the shaft in the trigger locking position. The flange 95 keeps the shaft 89 from moving forward beyond the travel needed to block the trigger. With this embodiment, once the shaft 89 moves to block the trigger, the unit has to be disassembled before the gun can be made operational again.

Figure 7:
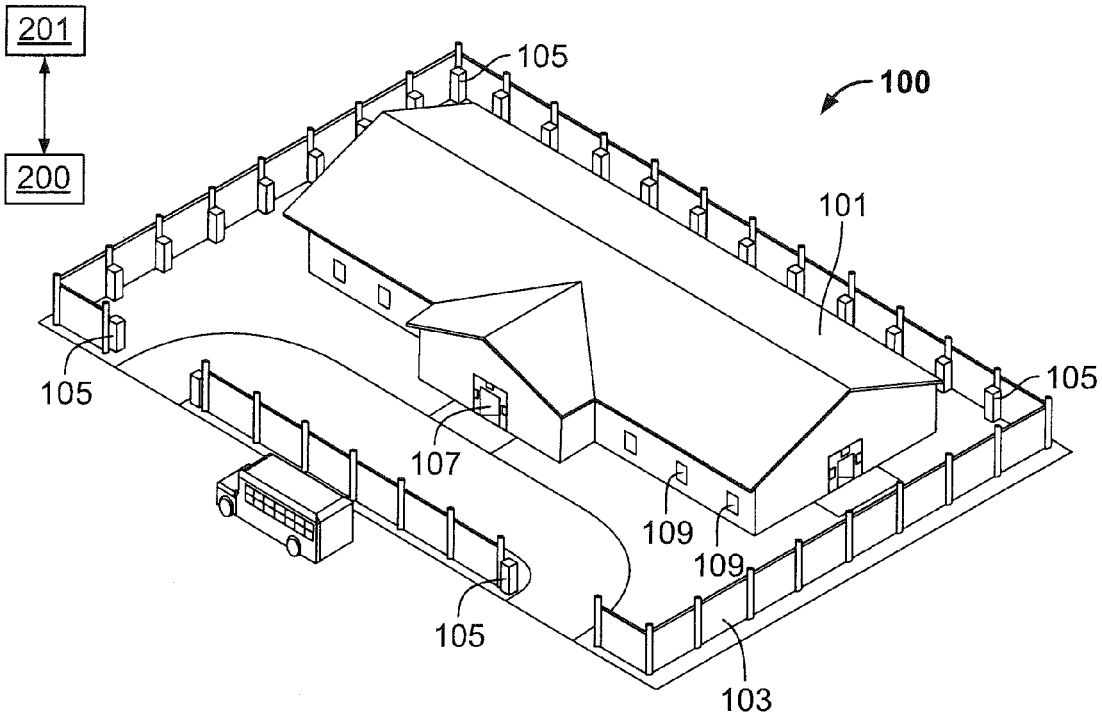
FIG. 7 shows a perspective view of a location depicting components of the system of the invention.

The invention can also include a control system with redundant processing unit that can include a number of features. One feature would be a central processing unit such as a PC or PLC that communicates with each wireless power source. This is shown schematically as reference numeral 200 in FIG. 7. The processing unit will be redundant for reliability. The processing unit will report any problems or needed information to a central monitoring office shown as 201 in FIG. 6 by way of the internet or direct wiring. Also e-mailing those problems out to officials of the facility the system is operating in. The central monitoring office 201 can then send out local representatives to repair any reported problems. The monitoring of the loads in the wireless power sources can be used to detect the fact that a gun has been disabled. This information can then be sent to the control systems processing unit 200 through the system's communication network. The processing unit can then report the detection and disabling of a gun to the officials of the facility, to the central office, to local authorities for their response and or set off an alarming system.

The control system can also control and monitor the health of a backup power system. This system would provide power in the case of power outages at the protected facility. This could be in the form of a backup generator or back up power supply. The backup supplies could be used to protect the facility during the time between the power going down and the time required for local authorities to arrive and assess the situation.

The wireless power source can includes wireless power source units that will entail multiple units strategically placed around the entrances to the areas, buildings or vehicles being protected. The placement of these units will be made is such a way to require anyone entering the protected areas to pass within a specified distance of the units. The units can also be placed so that they are redundant. In this way, multiple units must be passed by to move further into the venue or structure.

If a gun equipped with the inventive trigger system passes within the specified distance of one of the units, it will be disabled. The gun will stay disabled even after being removed from the effective area of the unit. The unit is a unit producing energy waves that can be used by the receiver circuitry in the receiver unit 41 associated with the gun to provide power to the firearm firing cycle blocking mechanism. Examples of these blocking mechanisms are detailed above and an example of a power source would be one that generates electromagnetic waves to power the receiver unit 41 so that the electromagnetic energy would convert to another form of energy that would be used to disable the gun in one of the techniques described above this application.

FIGS. 7-11 show an example of a location that is secured using the wireless power source units. The location is designated by reference numeral 100 and shows a building 101, e.g., a school, that is surrounded by a fence or other barrier 103. The wireless power source units for the perimeter of the location are designated by the reference numeral 103. The building 101 include exterior doors 107, exterior windows 109 and interior doors 111.

Figure 8:
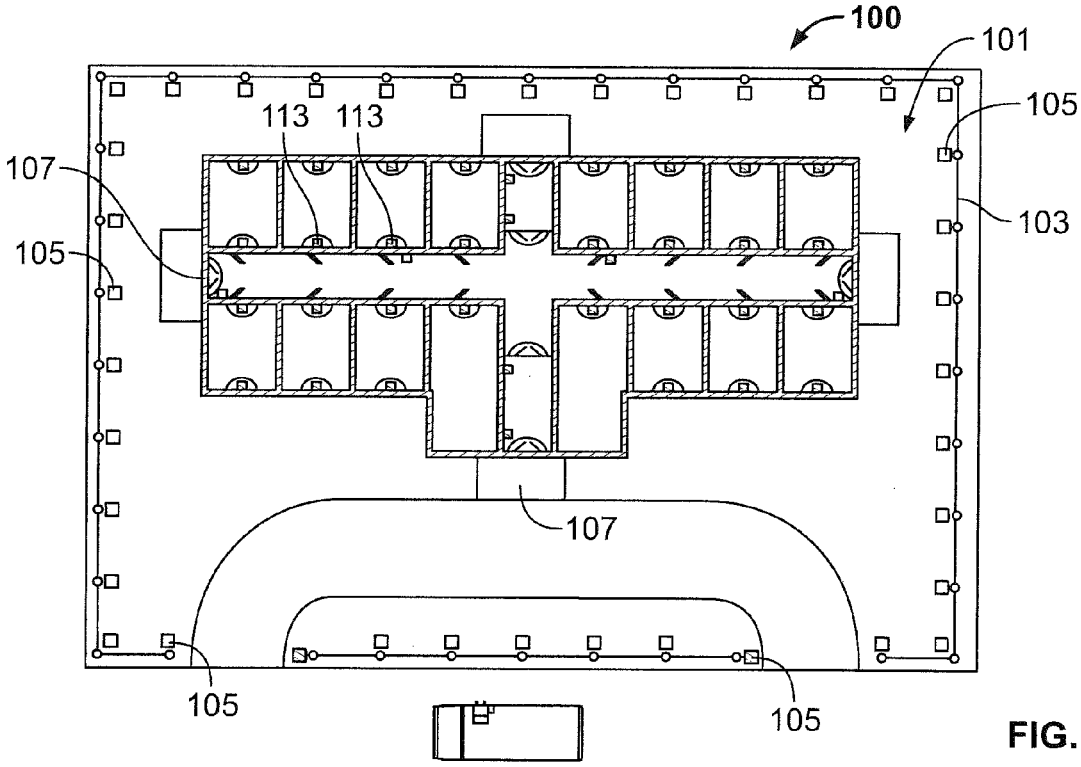
FIG. 8 shows a plan view of the location of FIG. 6 and inside details of the building depicted in FIG. 6.
Figure 9:
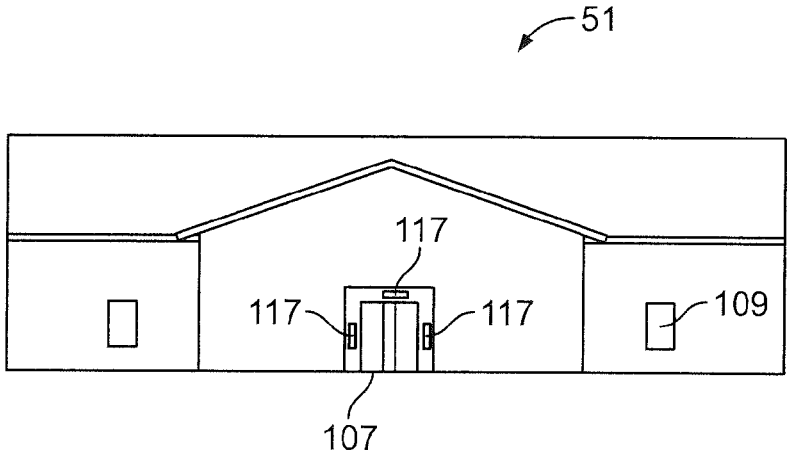
FIG. 9 shows a partial front view of the building of FIG. 6.
Figure 10:
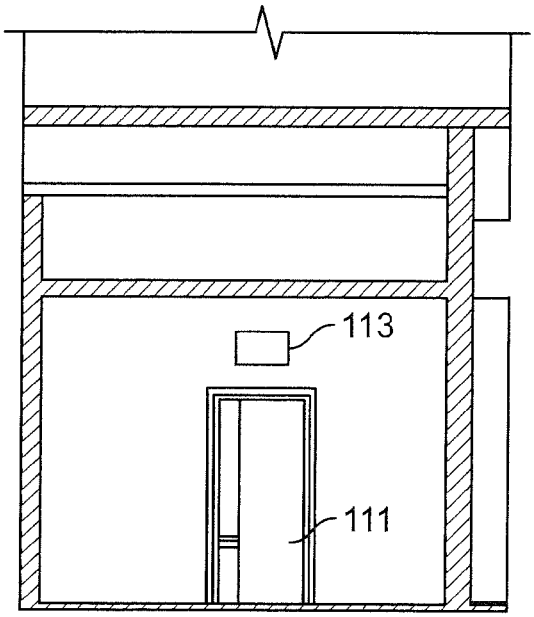
FIG. 10 shows an inside view of a door-containing room in the building of FIG. 6.
Figure 11:
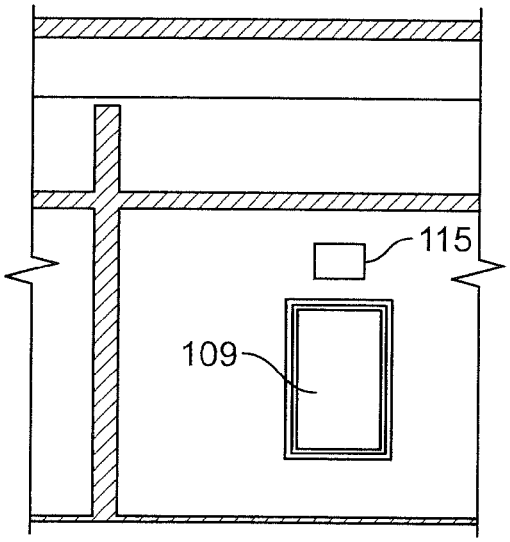
FIG. 11 shows an inside view of a window-containing room of the building of FIG. 6.

Referring to FIGS. 8, 10, and 11, the interior of the building is equipped with a number of wireless power sources 113 for the interior doors, and wireless power sources 115 for the windows 109. The exterior doors 107 can be equipped with wireless power sources 117. Having entry points of the location 100, either from a perimeter standpoint, exterior access or interior access, provides a complete coverage of the location with the wireless power source energy to assure that any gun having the inventive trigger locking mechanism is disabled. While a number of embodiments for the gun trigger lock device are shown, other trigger locking devices could be employed that would be activation by a wireless power sending device to disable the gun by preventing the trigger from being pulled. The exemplified trigger mechanisms correspond to means for preventing the pulling of the trigger and discharge of a gun by remote activation of the triggers using a wireless power sending device.

As such, an invention has been disclosed in Willis of preferred embodiments thereof which fulfills each and every one of the objects of the present invention as set forth above and provides a new and improved system and method for protecting a location from being subject to an unwanted shooting.

Of course, various changes, modifications and alterations from the teachings of the present invention may be contemplated by those skilled in the art without departing from the intended spirit and scope thereof. It is intended that the present invention only be limited by the terms of the appended claim.

I claim:

1. A gun shield system that will block functioning of a firearm that has passed within a specified distance from a wireless power unit comprising:

a) a trigger mechanism that includes a wireless power receiver and an activated trigger blocking device;

b) a control system to monitor system diagnostics for at least monitoring activation of the trigger blocking device, and optionally a back up power supply; and c) a plurality of wireless power sending units to provide power to the wireless power receiver for activation of the trigger blocking device without the need for a battery onboard the firearm.

2. The gun shield system of claim 1, wherein the trigger mechanism includes one of powder ignition in a locking cylinder, burning of a fusible link, and piercing of a gas cartridge into a cylinder.

3. A method of protecting an area from discharge of a gun comprising:

providing a trigger blocking device on the gun that prevents a trigger of the gun from being pulled when the trigger blocking device is activated, providing a plurality of wireless power sending units in the area, power sent by the wireless power sending units capable of activating the trigger blocking device and preventing the trigger from being pulled, wherein the gun will be prevented from firing without the need for a battery onboard the gun, wherein the locking of a gun trigger is monitored for reporting to authorities.

4. The method of claim 3, wherein the activating of the trigger blocking device only occurs when the gun is in the range of the wireless power sending units and when the gun is outside the range, the gun trigger can be pulled and/or activation of a firing cycle blocking occurs without any information exchange between the gun and the wireless power supply units and/or there are no codes that are read, received, or transferred between the wireless power sending units and the trigger blocking device.

5. The method of claim 3, wherein the activating of the trigger blocking device prevents the trigger of the gun from being pulled until the trigger blocking device is either replaced, reset or changed to allow it to again be activated.

6. The method of claim 2, further comprising one or more of:

a) a back up power unit for the wireless power sending units; and b) one or more additional wireless power sending units acting as a back up for the plurality of wireless power sending units.

7. A system for protecting an area from discharge of a gun comprising:

a trigger blocking device on the gun that prevents the trigger from being pulled when the trigger blocking device is activated without the need for a battery onboard the gun, a plurality of wireless power sending devices located in the area for activating the trigger blocking device to prevent the trigger from being pulled, and a control to monitor the activating of the trigger blocking to record trigger blocking events for reporting.

8. The system of claim 7, further comprising at least one of:

a) a back up power supply for the plurality of wireless power sending devices;

b) one or more additional wireless power sending devices acting as a back up for the plurality of wireless power sending devices; and c) optionally a control to monitor the back up power supply and the one or more additional wireless power sending devices.

9. A system for protecting an area from discharge of a gun comprising:

a trigger blocking device on the gun that prevents the trigger from being pulled when the trigger blocking device is activated without the need for a battery onboard the gun, a plurality of wireless power sending devices located in the area for activating the trigger blocking device to prevent the trigger from being pulled, wherein the trigger blocking device includes one of powder ignition in a locking cylinder, burning of a fusible link, and piercing of a gas cartridge into a cylinder.

10. A method of protecting an area from discharge of a gun comprising:

providing a trigger blocking device on the gun that prevents a trigger of the gun from being pulled when the trigger blocking device is activated, providing a plurality of wireless power sending units in the area, power sent by the wireless power sending units capable of activating the trigger blocking device and preventing the trigger from being pulled, wherein the gun will be prevented from firing without the need for a battery onboard the gun, wherein activation of the trigger locking device includes one of powder ignition in a locking cylinder, burning of a fusible link, and piercing of a gas cartridge into a cylinder.

* * * * *